US009062468B2

(12) United States Patent
Behringer

(10) Patent No.: US 9,062,468 B2
(45) Date of Patent: Jun. 23, 2015

(54) HEAD ATTACHMENT AND TEMPORARY SUPPORT POLE ASSEMBLY WITH HINGED DOOR RETAINER FOR SECURING FLEXIBLE PARTITION MATERIAL

(71) Applicant: Surface Shields, Inc., Orland Park, IL (US)

(72) Inventor: Kyle William Behringer, Mokena, IL (US)

(73) Assignee: Surface Shields, Inc., Cleveland, OH (US)

( * ) Notice: Subject to any disclaimer, the term of this patent is extended or adjusted under 35 U.S.C. 154(b) by 127 days.

(21) Appl. No.: 13/832,163

(22) Filed: Mar. 15, 2013

(65) Prior Publication Data

US 2014/0263916 A1 Sep. 18, 2014

(51) Int. Cl.
*A47H 13/00* (2006.01)
*E04G 21/24* (2006.01)

(52) U.S. Cl.
CPC ..... *E04G 21/24* (2013.01); *E04G 21/243* (2013.01)

(58) Field of Classification Search
CPC ..... E04G 21/24; E04G 21/243
USPC ..... 248/354.1, 357, 200.1, 229.16; 160/368.1, 351, 379
See application file for complete search history.

(56) References Cited

U.S. PATENT DOCUMENTS

| | | | | |
|---|---|---|---|---|
| 1,484,464 | A * | 2/1924 | Benson | 24/677 |
| 5,924,469 | A * | 7/1999 | Whittemore | 160/368.1 |
| 6,209,615 | B1 | 4/2001 | Whittemore | |
| 6,321,823 | B1 | 11/2001 | Whittemore | |
| 6,508,295 | B2 | 1/2003 | Whittemore | |
| 6,523,231 | B1 * | 2/2003 | Lassiter | 24/339 |
| 6,942,004 | B2 * | 9/2005 | Whittemore | 160/368.1 |
| 6,953,076 | B2 | 10/2005 | Whittemore | |
| 7,073,758 | B2 | 7/2006 | Whittemore | |
| 7,108,040 | B2 | 9/2006 | Whittemore | |
| 7,261,140 | B2 | 8/2007 | Whittemore | |
| 7,503,373 | B2 | 3/2009 | Whittemore | |
| 7,533,712 | B2 | 5/2009 | Whittemore et al. | |
| 7,658,219 | B2 * | 2/2010 | Whittemore | 160/368.1 |
| 7,717,382 | B2 | 5/2010 | Whittemore et al. | |
| 7,789,927 | B2 * | 9/2010 | Tramontina et al. | 55/491 |
| 7,810,771 | B1 * | 10/2010 | Akers et al. | 248/200.1 |
| 8,066,051 | B2 | 11/2011 | Whittemore | |
| 2004/0031892 | A1 * | 2/2004 | Whittemore et al. | 248/229.16 |
| 2005/0077015 | A1 * | 4/2005 | Melino et al. | 160/135 |
| 2007/0257170 | A1 * | 11/2007 | Whittemore et al. | 248/229.16 |
| 2009/0071614 | A1 | 3/2009 | Whittemore | |
| 2010/0237209 | A1 | 9/2010 | Whittemore et al. | |
| 2010/0301000 | A1 | 12/2010 | Whittemore | |

* cited by examiner

*Primary Examiner* — Amy Sterling
(74) *Attorney, Agent, or Firm* — Fay Sharpe LLP

(57) ABSTRACT

A temporary support pole assembly including removable head attachment is disclosed. The head attachment includes a pivotally movable retainer selectively positionable relative to the head between an open position and a closed position to retain and secure a flexible partition material thereto.

39 Claims, 5 Drawing Sheets

HEAD ATTACHMENT AND TEMPORARY SUPPORT POLE ASSEMBLY WITH HINGED DOOR RETAINER FOR SECURING FLEXIBLE PARTITION MATERIAL

BACKGROUND OF THE INVENTION

The field of the invention relates generally to removable head attachments for mounting on ends of temporary support poles at a construction or remodeling job site, and more specifically to a head attachment and pole assembly for securing a flexible partition material to erect temporary walls or partitions on a job site.

It is known to provide one or more temporary support poles having removable head attachments on construction and remodeling job sites. The poles and head attachments may serve a variety of purposes such as holding drywall in place for installation, holding cabinets in place for installation, and assembling temporary walls or partitions to control and contain dust accumulation, among other things, on a construction site. Such temporary walls may be assembled, for example, to isolate finished areas from work areas within an existing structure so that the finished areas will not be contaminated by construction dust and by-products. The temporary walls are fabricated from a flexible partition material, such as sheet or curtain materials, that is draped and held in place with the temporary support poles.

BRIEF DESCRIPTION OF THE INVENTION

An embodiment of a head attachment for a temporary support pole is disclosed. The head attachment includes a body having a generally planar upper surface and a lower surface opposing the upper surface, and a pivotally movable retainer element coupled to the body and selectively positionable relative to the upper surface between an open position and a closed position. The pivotal retainer element has an upper side and a lower side opposing the upper side. The upper side of the retainer element is generally parallel with the upper surface of the body when the retainer is in the closed position.

Optionally, the upper side of the retainer element may be recessed from the upper surface of the body when in the closed position. The retainer element may be hingedly attached to the body. The upper surface of the body may define a rim extending around the retainer element. The rim may be U-shaped, and at least one recessed surface may extend adjacent the rim. A gasket may also be applied to the rim, and the gasket may be U-shaped.

The retainer element may also be nested in the upper side of the body when in the closed position, and the retainer element may pivot upwardly and outwardly away from the engagement surface when moved from the closed position to the opened position. The retainer element may also include a latching element. The latching element may include a pointed distal end. The body may include a front side and a rear side opposing the front side, with the front side including a slot, and the distal end of the latching element being received in the slot when the latching element is closed. The retainer element may include an upper surface, and the latching element may be recessed relative to the upper surface of the retainer element.

The body may also include an external side, and the retainer element may be attached to the body along the external side. At least one aperture may be formed in the body, with the aperture providing access to the retainer element so that the retainer element can be raised from the closed position.

The head attachment may also include an attachment portion configured for threaded engagement with the support pole. The head attachment may also include a flange configured for connection to the temporary support pole and at least one rib supporting the flange. The rib may have a bowed curvature imparting a variable thickness along an axial length thereof.

An embodiment of a support pole assembly for erecting a temporary partition on a job site with at least one support pole section is also disclosed. The assembly includes a head attachment mountable to the support pole section on one end; the head attachment comprising a body and a retainer element hingedly attached to the body. The retainer element is movable upwardly and outwardly away from a first portion of the body to an open position for draping a flexible partition material over a second portion of the body and a closed position capturing the partition material between the retainer element and the first portion of the body.

Optionally, the head attachment is mountable to the support pole section with threaded engagement. The head attachment may include an upper side formed as a U-shaped rim, the U-shaped rim extending around the retainer element. The head attachment may also include a rear surface that is recessed from the rim. The retainer element may be recessed from the rim when the retainer is in the closed position.

As another option, the head attachment may include an upper side defining a rim, and a gasket applied to at least a portion of the rim. The gasket may be U-shaped.

The retainer element may further include a latching element. The latching element may be configured to pierce the partition material. The partition material may be a curtain. A flange may be provided that is configured for connection to the at least one support pole section. At least one rib may be provided to support the flange. The rib may have a bowed curvature imparting a variable thickness along an axial length thereof.

An embodiment of a support pole assembly for erecting a temporary wall with a curtain on a job site has also been disclosed. The assembly includes: at least one support pole section having a threaded member; a head attachment configured to engage the threaded member, the head attachment defining a recess; and a retainer element hingedly attached to the head surface proximate the recess, the retainer element movable upwardly and outwardly away from the recess to an open position for draping the curtain over a portion of the head attachment and a closed position capturing a portion of the curtain in the recess.

Optionally, the head attachment may define an upper side for engagement with the curtain, and the retainer may be substantially parallel with the upper side when in the closed position. The retainer may also be recessed from the upper side when in the closed position. The head attachment may include a latching element. The threaded element may be one of a threaded stud and an adaptor configured for coupling with a threaded stud.

As further options, the head assembly may also include a flange configured to engage the threaded member, and at least one rib supporting the flange. The rib may include a bowed curvature imparting a variable thickness along an axial length thereof. A gasket may extend on an upper surface of the head attachment, and the gasket may be U-shaped.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
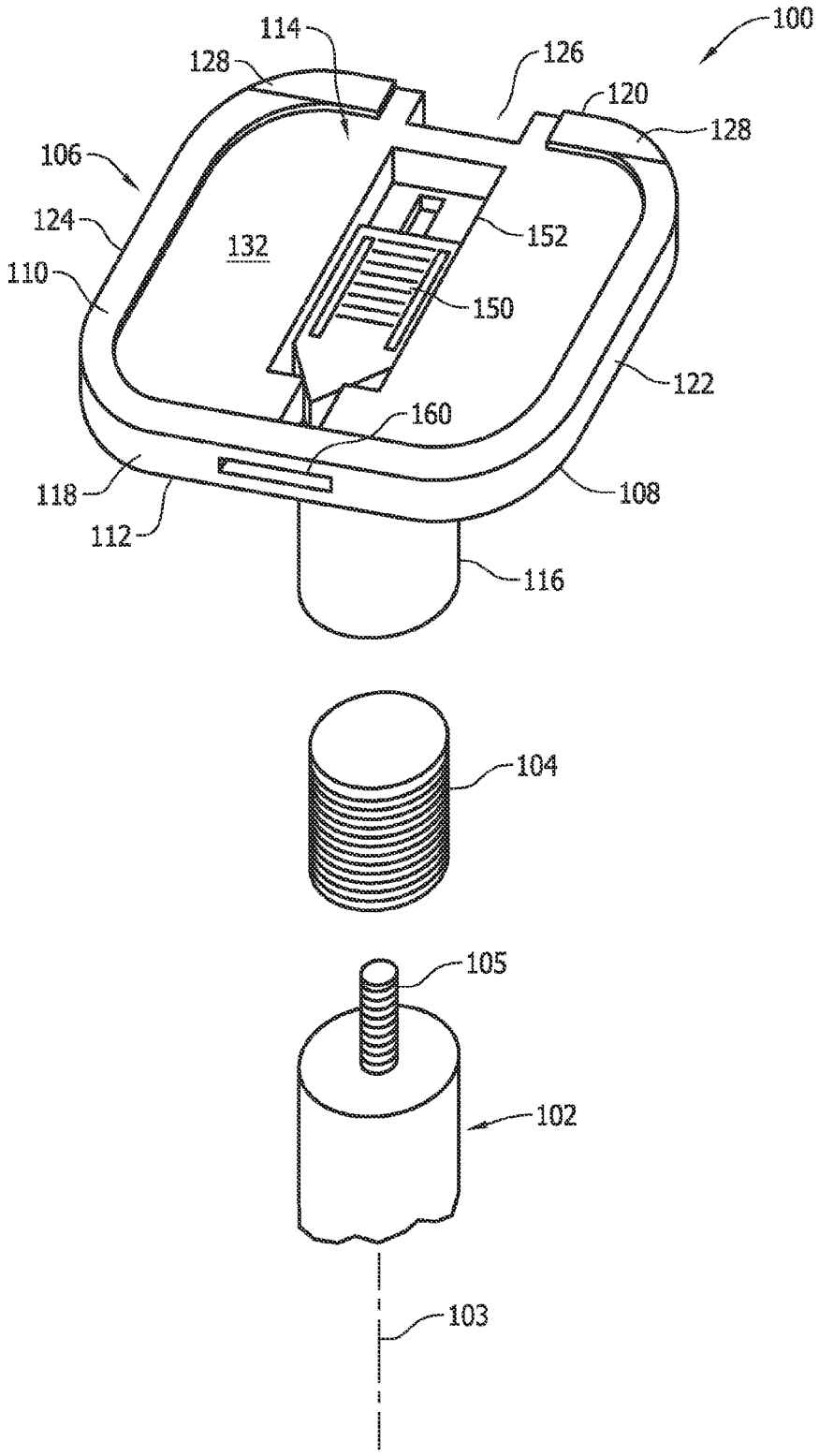
FIG. 1 is a partial top perspective view of a support pole assembly having a head attachment formed in accordance with a first exemplary embodiment of the invention and having a curtain retainer in a closed and unlatched position.

FIG. 1 is a partial top perspective view of a support pole assembly 100 for erecting a temporary wall or partition on a job site wherein, for example, construction or remodeling activity is being undertaken.

The support pole assembly 100 generally includes, as shown in FIG. 1, a support pole 102 including a coupler 104, and a head attachment 106 that is removably attachable from the support pole 102 via the coupler 104.

The pole 102 is fabricated from known materials in one or more sections having a generally elongated axial length measured along a longitudinal axis 103 and may be adjustable in length as those in the art will appreciate to accommodate different floor-to-ceiling heights, for example, in use. The pole 102 may be preassembled with multiple sections or may include multiple threaded pole sections that may be assembled on the job site. In a multiple pole section embodiment, the overall length of the combined pole sections may be adjustable, for example, by twisting or sliding one pole section relative to the other to advance the ends of the pole sections toward or away from one another in a telescoping manner, and locking the pole sections in place to maintain a desired axial length of the pole 102. While fabrication of the pole 102 in sections is beneficial for the reasons stated, it is contemplated that the pole 102 in different embodiments may be a single section elongated pole having a fixed length.

The coupler 104 is attached to the distal end of the pole 102 and in the example shown includes threads with which the head attachment 106 may be securely mated. In one contemplated embodiment, the coupler 104 is provided as an adapter that is fitted with a threaded stud 105 provided on the end of the pole 102. In such an embodiment, the coupler 104 includes internal threads having a smaller diameter engaging the smaller diameter stud 105 of the pole 102, and external threads having a larger diameter for engagement with the head attachment 106. By providing such an adaptor as the coupler 104, the pole 102 may be used with other attachments and for other purposes that do not require the coupler 104.

In another embodiment, however, the coupler 104 having the appropriate diameter of threads for coupling with the head attachment 106, may itself be provided on the distal end of the pole in lieu of the stud 105. In such an embodiment, the head attachment may be directly attached to the larger diameter coupler 104 without using any type of adapter.

In still another embodiment, the pole coupler 104 and the stud 105 could be configured so that they could each be used interchangeably with the pole 102. As such, the terminal stud 105 could be removed from the distal end of the pole 102 and replaced with the coupler 104, or the coupler 104 could be removed from the distal end of the pole 102 and replaced with the stud 105. Various other adaptations are possible.

Regardless, in the example shown the threaded engagement of the head attachment 106 and the coupler 104 provides a fixed and rigid structural connection between the pole 102 and the head attachment 106. Once the head attachment 106 is engaged to the threaded coupler 104, the orientation of the head attachment 106 relative to the pole 102 is not adjustable. In other words, and because of the threaded engagement, the head attachment cannot pivot or tilt relative to pole axis 103 at the end of the pole 102 to change the working angle of the head attachment 106 as it engages a ceiling. In other embodiments, however, it is understood that non-threaded couplers could be used that may allow for pivotal or tilted adjustment of the working angle if desired, including but not limited to ball and socket-type coupling techniques familiar to those in the art.

The head attachment 100 generally includes a rectangular body 108 having an upper side or surface 110 and a lower side or surface 112 opposing the upper side 110. The body 108 is provided with a curtain retainer element 114 on the upper side 108 and with a cylindrical attachment flange 116, sometimes referred to as a stem, on the lower side 112. The curtain retainer 114 secures a curtain material (not shown in FIG. 1) to the attachment head 106, while the flange 116 mates with the coupler 104 on the pole 102 and secures the head attachment 106 to the pole 102.

The body 108 in the exemplary configuration shown includes a front side 118, a rear side 120 opposing the front side 118, and opposing lateral sides 122, 124 interconnecting the front at rear sides 118, 120. The sides 118, 120, 122, 124 extend generally parallel to the longitudinal axis 103 of the pole 102, are about the same length, and generally impart a square shape to the body 108. The sides 118, 120, 122, 124 also include rounded corners at their ends where the sides meet one another. Other shapes and geometric configurations of the body 108 are, of course, possible in various other embodiments, including but not limited to rectangular shapes having sides of unequal length, other non-rectangular polygonal shapes, and non-polygonal shapes such as circles or ellipses.

The top side or upper side 110 of the body 108 as shown is generally planar and extends in a generally U-shaped configuration as shown in FIG. 1. The upper side 110 extends in a plane generally perpendicular to the axis 103 of the pole 102 and generally perpendicular to the front side 118, the rear side 120, and the opposing lateral sides 122, 124. The upper side 110 in the example shown defines an elongated rim surface extending adjacent the entire front side 118, and most of the lateral sides 122, 124. In the example shown, however, the upper side 110 does not extend along the rear side 120 of the body 108.

Figure 3:
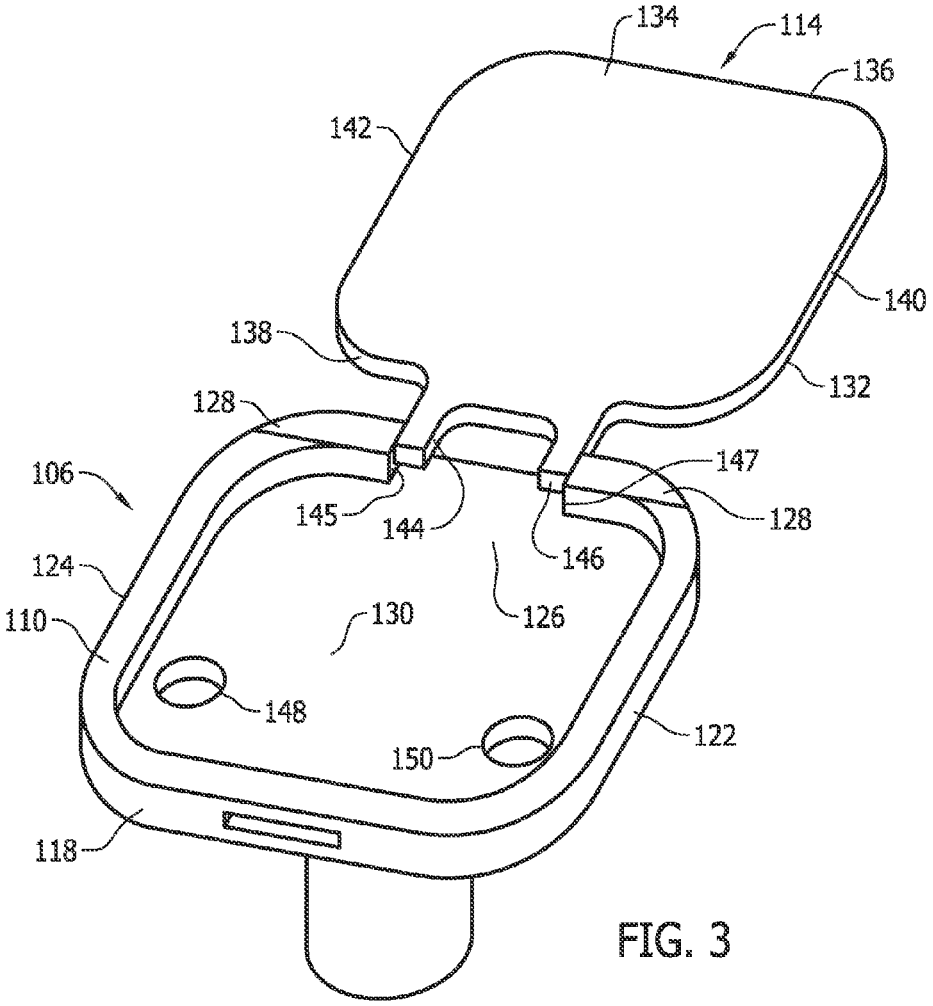
FIG. 3 is a top perspective view of the head attachment shown in FIGS. 1 and 2 with the curtain retainer in an opened position.

The rear side 120 of the body 108 is formed with a central opening or cutout 126, and recessed upper surfaces 128 extend between the opening 126 and to the respective lateral sides 122 and 124. As shown in FIG. 3, a second recessed surface 130 is formed on the inner periphery of the upper side 110. The second recessed surface 130 accommodates the curtain retainer 114 such that a top surface 132 of the retainer 114 is recessed from the upper side 110, and the upper side 110 generally extends around the retainer 114. When the retainer 114 is in the closed position as shown in FIG. 1, the upper side surface 110 is elevated from the rear side surfaces 128 and also the top surface 132 of the retainer element 114 in the exemplary embodiment shown. Also, the top surface 132 of the retainer element 114 is generally planar, and in the closed position the retainer top surface 132 is oriented generally parallel to, but spaced from, the plane of the upper side 110.

The retainer element 114, as best seen in FIGS. 1 and 3, is shaped generally complementary to the upper side 110 of the body 108 but at a reduced dimension such that the retainer element 114 is inset in the upper side 110 when the retainer element is in the closed position shown in FIG. 1. Thus, the retainer element in the illustrated example is generally square in shape and includes the upper side 132, a lower side 134 (FIG. 33) opposing the upper side 132, a front edge 136, a rear edge 138 and lateral side edges 140 and 142.

The curtain retainer 114 is formed with a pair of hinge arms 144, 146 extending from the rear edge 138. The hinge arms 144, 146 extend to the opening 126 in the rear wall 120 of the body 108, and the hinge arms 144, 146 are rotatably attached to the rear side 120 of the body 108 at end walls 145, 147 (FIG. 3). In contemplated embodiments, one of the end walls 145, 147 and the hinge arms 144, 146 are provided with hinge pegs that are received and rotated in apertures formed in the other of the end walls 145, 147 and the hinge arms 144, 146. Other hinge arrangements are possible, however, allowing the curtain retainer 114 to be moved between a closed position (FIG. 1) nested within the body upper side 110, and an opened position (FIG. 3) creating a receptacle for securing a portion of curtain material between the body 108 and the retainer 114.

Figure 2:
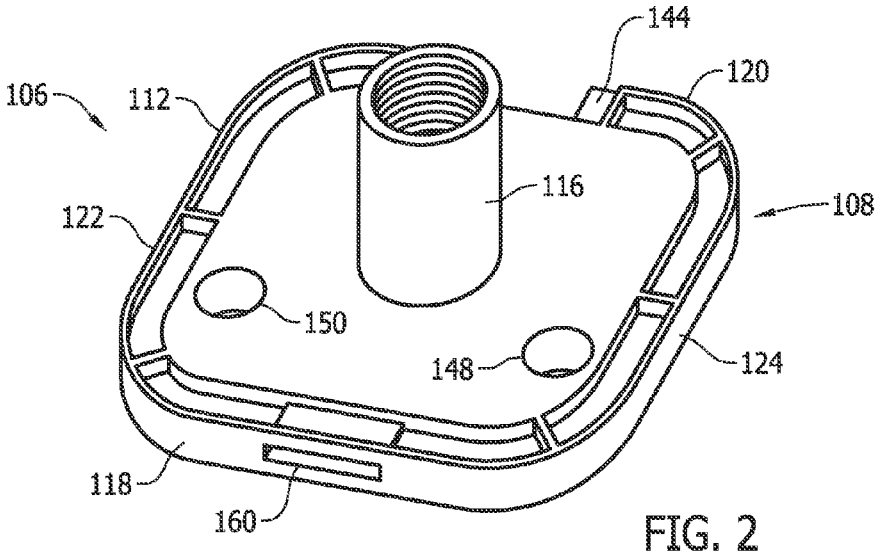
FIG. 2 is a bottom perspective view of the head attachment shown in FIG. 1.

As shown in FIGS. 2 and 3, apertures 148, 150 are provided in the body 108 at a location interior to the upper side 110 for one's fingers to push the retainer 114 open from the lower side 134 for rotation about the hinges as shown. Because the retainer 114 is nested in the upper side 110 when in the closed position, it is difficult to open the retainer 114 from the top side of the head attachment 104, so by accessing the retainer 114 from underneath via the apertures 148, 150, the retainer 114 may be relatively easily raised until it can be grasped from the top side and rotated to the opened position.

Figure 4:
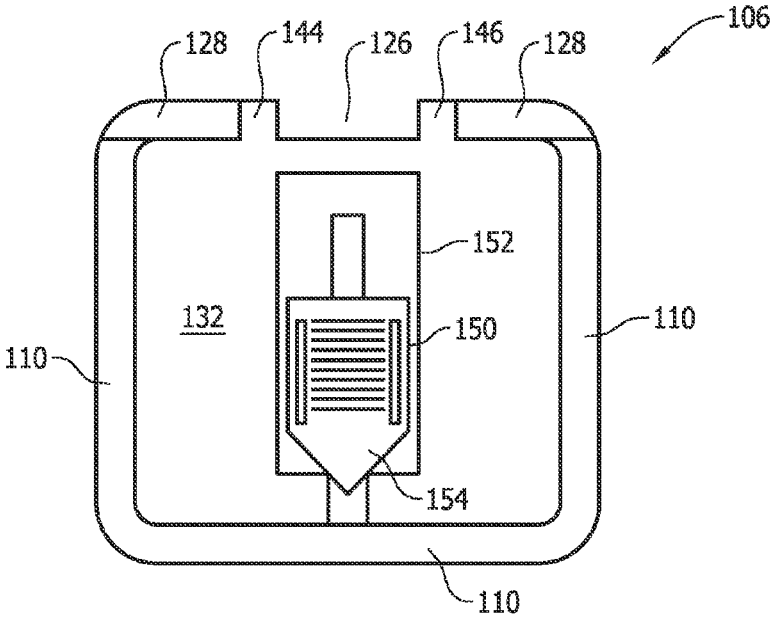
FIG. 4 is a top view of the retainer shown in FIGS. 1-3 with the curtain retainer closed and a latching element in an unlatched position.
Figure 5:
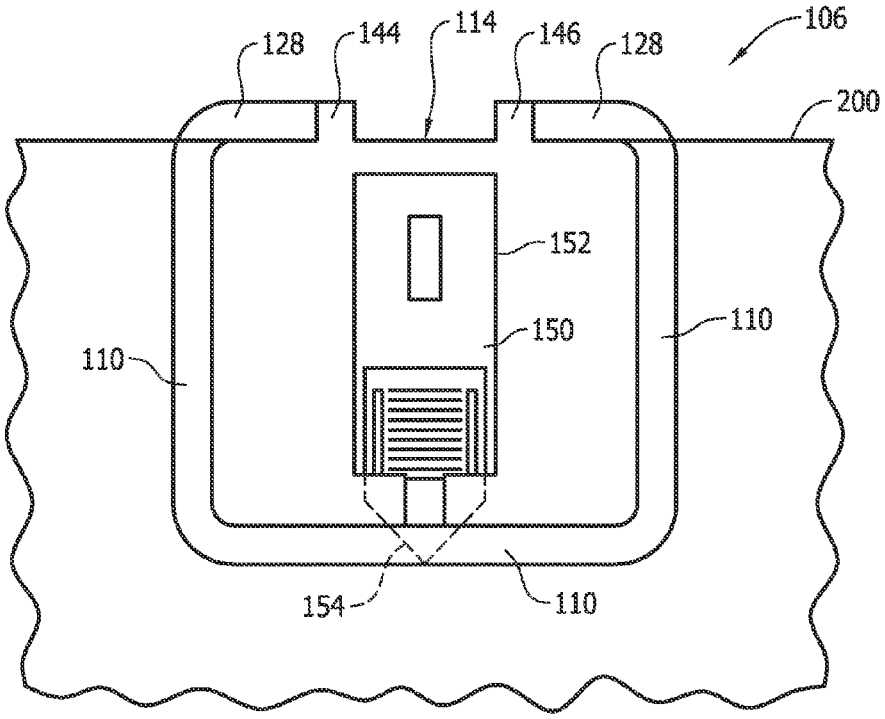
FIG. 5 is view similar to FIG. 4 but showing the latching element in a latched position and, in combination with the curtain retainer, securing a curtain material to the head attachment.
Figure 6:
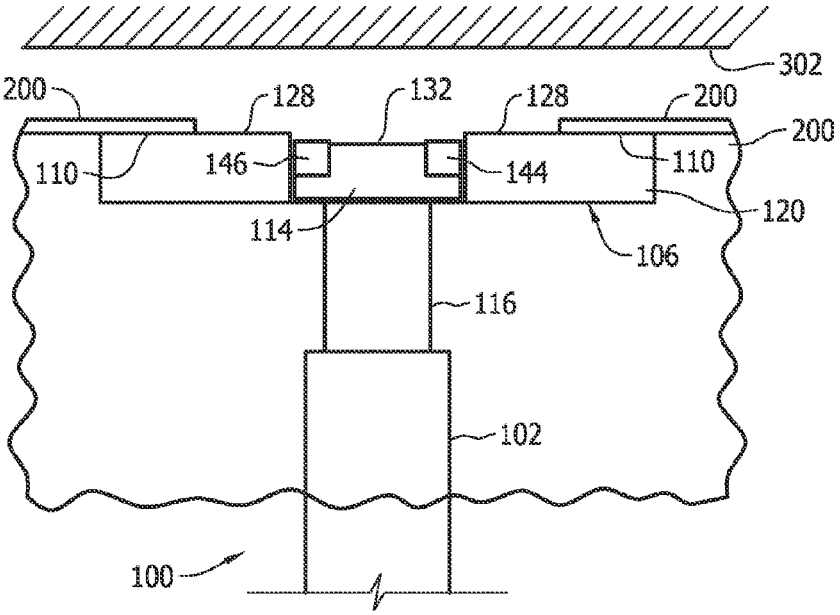
FIG. 6 is a partial rear elevational view of the support pole assembly shown in FIG. 1 being engaged to a ceiling on a job site.

The retainer element 114 is further provided with a latch element 150 that is movable in a recessed slot 152 formed in the upper side 132 of the retainer 114. The slot 152 and/or the latching element 152 may be formed with guiding an alignment features to provide a slidable motion of the latch element 152 along a linear path in a direction toward or way from the body front side 118 as explained below. As also shown in FIGS. 5 and 6, the latch element includes a pointed, triangular leading end 154 that may pierce or penetrate a portion of a curtain material 200 (FIG. 4) that is secured to the head attachment 106 with the retainer 114. The latch element 152 is generally slidably positionable with a person's thumb, for example, between an unlatched position (FIG. 4) and a latched position (FIG. 5) wherein the leading end 154 of the latch penetrates the curtain material 200. The combination of the closed retainer element 114 and the latching of the latching element 150 securely holds the curtain material in place. As such, the head attachment 106 does not rely solely upon frictional forces to retain the curtain material.

In the unlatched position, the leading end 154 of the latching element 152 is spaced from the front side 118 and the upper side 110, and hence does not interfere with or prevent the retainer 114 from being opened. In the latched position, however, the leading end 154 of the latching element 152 extends partly into a slot 160 formed in the front side 160 (FIG. 1) of the body 108 beneath the upper side 110. The extension of the end 154 of the latching element 152 into the slot 160 locks the retainer 114 closed and precludes an inadvertent opening of the retainer 114, as well as prevents the retainer 114 from being opened, without first moving the latch element 152 to the unlatched position. Furthermore, in the latched position, the retainer 114 is prevented from inadvertent opening as the head attachment 106 is handled. Thus, positive latching or unlatching of the retainer 114 both enhances the retention of the curtain material and protects the retainer 114 from being inadvertently damaged.

While an exemplary latching element 152 is described, it is recognized that other latching elements are known in the art and may be utilized to retain the door 114 in a closed position and/or to provide further securement of the curtain material in another manner. For example only, magnetic latching features could be utilized in other embodiments.

The lower side 112 of the head attachment 106 includes the generally cylindrical flange 116 as shown in FIG. 2 approximately centered in the body 108 and extending outwardly in a direction perpendicular to the lower side 112. The flange 116 includes internal threads for mating engagement with the threaded coupler 104. The head attachment 106 may therefore be quickly and easily mounted to and removed from the pole 102 by threading the flange 116 to the coupler 104 by hand and without tools.

As mentioned above, while threaded engagement of the coupler 104 and the head attachment 106 is shown in the exemplary embodiment depicted, other types of engagement are possible and may be utilized. For example, ball and socket-type connections are known in the art and may alternatively be utilized, as well as other known socket and coupler arrangements, or other fastening methods whether or not involving a socket, may alternatively be utilized in other embodiments with similar effect to removably couple the head attachment 106 to the pole section 102.

The head attachment 106, including the body 108, the retainer 114 and the latching element 152 may be fabricated from durable molded plastic materials according to known techniques in an exemplary embodiment, although other materials may also be utilized if desired.

By virtue of the hinged connection and the aperture 126 at the rear side 120 of the body 108, the retainer element 114 may pivot or swing upwardly and outwardly away from the upper side 110 of the body 108 from the closed position (FIGS. 1 and 4) to the open position (FIG. 3) and even beyond. In one embodiment, the front side 144 of the retainer element may travel a substantially 270° arcuate path from a fully closed to a fully opened position as the pivot arms 144, 146 are rotated about the hinged connection with the rear side 120 at the end walls 145, 147. That is, the retainer element 114 opens and closes in a door-like manner away from and toward the body 108. The retainer element 114 is therefore sometimes referred to as a retaining door.

When fully opened, the retainer door 114 beneficially provides clear and unobstructed access to fit the curtain material 200 (FIG. 4) over the upper side 310 of the body 108. When the retainer 114 is closed with the curtain material in place, the curtain material is trapped between the lower side 134 of the retainer door 114 and the recessed surface 130 (FIG. 3) of the receptacle. The latching element 152 may then be moved to the latched position as shown in FIG. 4. By penetrating the curtain material as the latching element 152 is latched, further mechanical retention of the curtain material is provided. As seen in FIG. 4, the curtain material 200 is draped over the upper side 110, but does not extend over the recessed rear surfaces 128 of the body 108. In other words, the edge of the curtain material is generally aligned with the inner edge of the surface 128 at the rear side 120 but does not cover the surface 128. Otherwise, the curtain material 200 would generally interfere with closing of the retainer 114.

Figure 7:
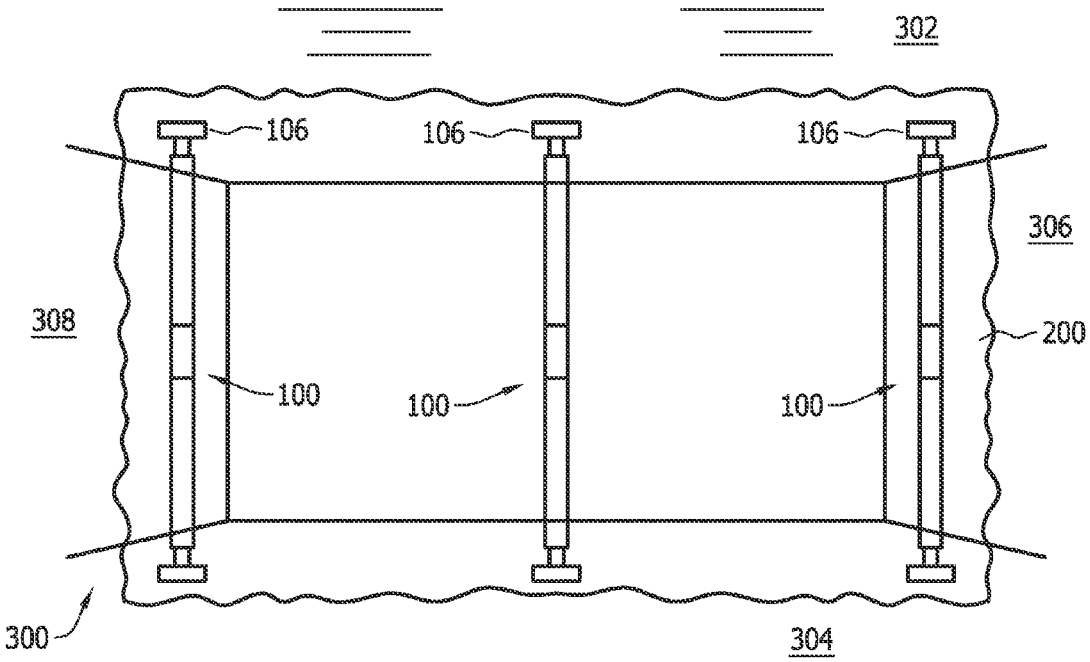
FIG. 7 illustrates in front perspective view a plurality of support pole assemblies supporting a temporary partition on the job site.

FIGS. 6 and 7 illustrate the curtain material 200 utilized to erect a temporary wall with the curtain material 200. Curtain material 200 is shown mounted to a plurality of poles 102 via the head attachments 106. As shown in FIGS. 6 and 7, as the head attachment engages a ceiling 302 of a room 300 the curtain material 200 is draped from the head attachments 106 and generally extends from the floor 304 to the ceiling 302 and between adjacent poles 102. The curtain material 200 overlies the upper side 110 of the head attachment 106, and the curtain material makes direct contact with the ceiling as the head attachment 106 approaches the ceiling 302.

As can be seen from FIG. 6, however, the surfaces 128 of the rear side 120 of the head attachment body 108 are recessed from the upper side 110 of the head attachment 106 and also recessed from the curtain material draped over the top of the upper side 110. As such, the surfaces 128 of the rear side 120 are spaced from the ceiling when the curtain material 200 is in contact with the ceiling 302. The upper side 132 of the curtain retainer 114 is also recessed from the upper side 110 and the curtain material 200 that covers the upper side 110, so the retainer 114 is also spaced from the ceiling when the curtain material 200 is in contact with the ceiling 302. Only the curtain material 200 is actually in contact with the ceiling 302 as the head attachment 106 is used, and because of the shape of the upper side 110, a relatively small, but effective, contact area between the curtain material 200 and the ceiling 302 is created. This arrangement tends to protect the ceiling from damage when using the poles, provides some protection to the retainer 114 from being inadvertently damaged as the poles are used, and provides some protection for the hinged connection of the retainer 114 at the rear side 120 of the head attachment 106. The hinged connection of the retainer 114 is mechanically isolated from compression forces when the head attachment 106 is engaged with the ceiling.

A temporary partition or wall with the curtain material 200 may be created between opposing walls 306 and 308 of the room 300 to separate one portion of the room from another as shown in FIG. 7. As such, a portion of the room 300 on one side of the partition may be isolated from the portion of the room 300 on the other side to contain construction dust, debris, etc. in the portion of the room wherein work is being undertaken. As such, a finished area of the room 300 may be protected or preserved in a clean condition while work is undertaken in another portion of the room 300. When work is completed, the poles 100 and the partition material 200 are removed from the site.

Many configurations of such temporary partitions are possible involving different numbers of poles, different lengths of poles, and different partition materials such as plastic sheets, fabrics, cloths, drapes, tarps, and the like familiar to those in the art. Such partitions may be assembled to extend between adjacent walls in a room, opposing walls in a room, or to partition an area in a room that is not bordered by an existing wall of the room. Openings may be provided, if necessary in the partitions to allow workers to enter or leave partitioned areas.

Figure 8:
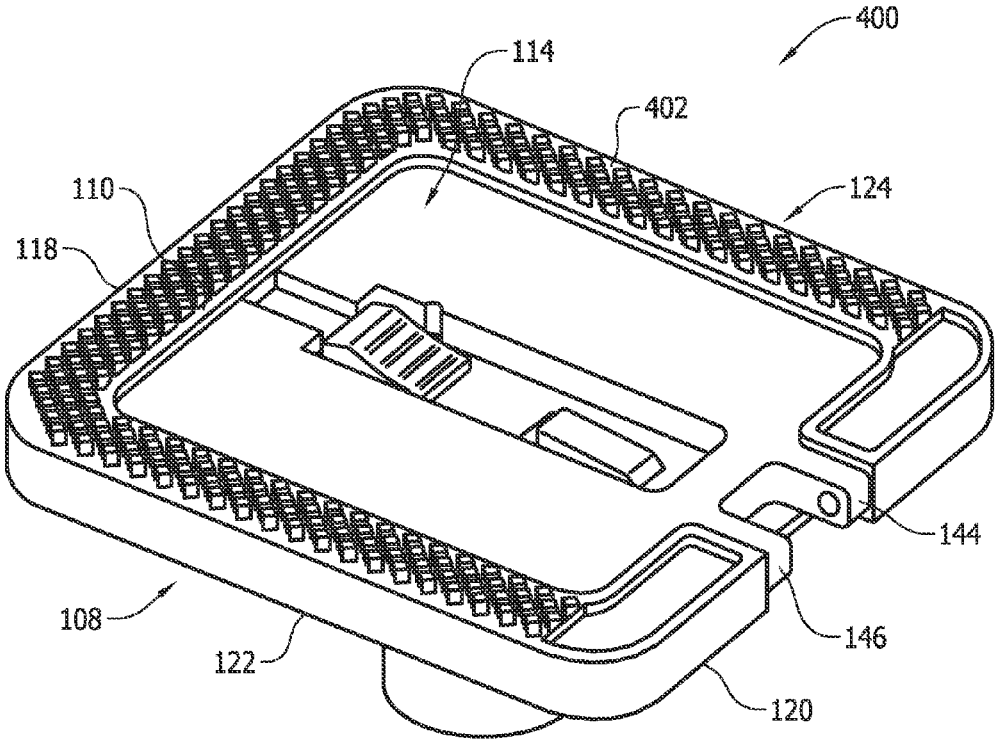
FIG. 8 is a top perspective view of a head attachment for a support pole assembly formed in accordance with a second exemplary embodiment of the invention.
Figure 9:
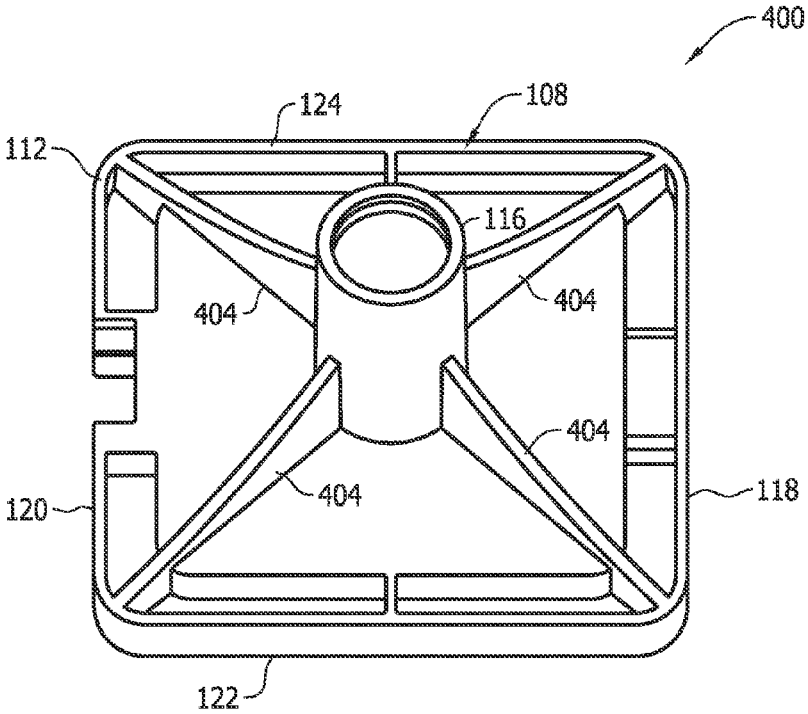
FIG. 9 is a bottom perspective view of the head attachment shown in FIG. 8.

FIGS. 8 and 9 are top and bottom perspective views of a second exemplary embodiment of a head attachment 400 that may be utilized in the support pole assembly described above in lieu of the head attachment 106 described above.

Like the head attachment 106, the head attachment 400 similarly includes a body 108 that in the exemplary configuration shown includes a front side 118, a rear side 120 opposing the front side 118, and opposing lateral sides 122, 124 interconnecting the front at rear sides 118, 120. The sides 118, 120, 122, 124 generally impart a square shape to the body 108. The sides 118, 120, 122, 124 also include rounded corners at their ends where the sides meet one another. As noted previously, other shapes and geometric configurations of the body 108 are possible in various other embodiments, including but not limited to rectangular shapes having sides of unequal length, other non-rectangular polygonal shapes, and non-polygonal shapes such as circles or ellipses.

Also like the head attachment 106, the top side or upper side 110 of the body 108 of the head attachment 400 as shown is generally planar and extends in a plane generally perpendicular to the axis of the pole (such as the axis 103 of the pole 102 shown in FIG. 1) and generally perpendicular to the front side 118, the rear side 120, and the opposing lateral sides 122, 124. Unlike the head attachment 106, the upper side 110 of the head attachment 400 in the example shown defines an elongated rim surface extending adjacent the entire front side 118, the entirety of each of the lateral sides 122, 124 and a portion of the rear side 120.

A gasket 402 is applied to the upper side 110 of the head attachment 400, and in the exemplary embodiment shown, the gasket 402 includes a non-slip upper surface that is elevated from the upper side. The gasket 402 further extends in a U-shaped configuration extending on the upper surface 110 entirely across the front side 118, most of the lateral sides 122, 124, but not across the rear side 120. As such, the rear side 120 has an upper surface that is recessed from the upper surface of the gasket 402. As such, when the upper surface of the gasket 402 is engaged to a ceiling or other object in use, the upper surface of the rear side 120 does not engage the ceiling or other object.

As shown in FIG. 9, the head attachment also includes a plurality of solid support ribs 404 extending about the cylindrical attachment flange 116, sometimes referred to as a stem, on the lower side 112. The support ribs 404 connect to the flange 116 at one end, and extend to the rounded corners of the lower side 112 at their opposing ends. As such, and in the example shown, the ribs 404 extend diametrically across the lower side 112 of the head attachment 400. The ribs 404 as shown further include a bowed or arcuate curvature along their axial lengths, such that the ribs 404 are thicker near the flange 116 than at their ends adjacent the corners of the lower side 112. The ribs 404 provide additional structural strength and rigidity to the head attachment 400 to better withstand manufacturing processes and rugged use in the field. While four ribs 404 are shown, greater or fewer numbers of ribs having the same or different configuration may alternatively be provided for similar purposes.

The curtain retainer 114 is constructed, installed, and operable in a similar manner for the head attachment 400 as described above for the head attachment 406, with similar benefits and advantages.

The above-described head attachments and pole assemblies are believed to be particularly advantageous and beneficial over existing head attachments and pole assemblies. The retainer elements described are believed to be easier to use than some conventionally provided retainers, and also are believed to be more durable and may be manufactured at lower cost. The described head attachments and retainers are believed to be particularly advantageous for securing partition materials to the temporary support pole sections, but it is contemplated that other materials, items, and articles may likewise be reliably secured to the head attachments for purposes other than erecting temporary partitions. As such, the invention is not believed to be solely limited in application to securing flexible partition materials. The benefits of the invention are believed to be equally applicable to non-partition applications and the present disclosure is not intended to preclude such possibilities.

While the invention has been described in terms of various specific embodiments, those skilled in the art will recognize that the invention can be practiced with modification within the spirit and scope of the claims.

What is claimed is:

1. A support pole assembly for erecting a temporary partition on a job site with at least one support pole section; the assembly comprising:

a head attachment mountable to the support pole section on one end; the head attachment comprising a body and a retainer element hingedly attached to the body, the retainer element being movable upwardly and outwardly away from a first portion of the body to an open position for draping a flexible partition material over a second portion of the body and a closed position capturing the partition material between the retainer element and the first portion of the body, an upper side of said retainer element is recessed from said upper surface of said body when in said closed position.

2. The support pole assembly of claim 1, wherein the head attachment is mountable to the support pole section with threaded engagement.

3. The support pole assembly of claim 1, wherein the head attachment comprises an upper side formed as a U-shaped rim, the U-shaped rim extending around the retainer element.

4. The support pole assembly of claim 3, wherein the head attachment further comprises a rear surface that is recessed from the rim.

5. The support pole assembly of claim 1, wherein the head attachment comprises an upper side defining a rim.

6. The support pole assembly of claim 5, further comprising a gasket applied to at least a portion of the rim.

7. The support pole assembly of claim 6, wherein the gasket is U-shaped.

8. The support pole assembly of claim 7, wherein the head attachment comprises a rear side having an upper surface, the upper surface of the rear side being recessed from an upper surface of the gasket.

9. The support pole assembly of claim 5, wherein the retainer element is recessed from the rim when the retainer element is in the closed position.

10. The support pole assembly of claim 1, wherein the retainer element further comprises a latching element.

11. The support pole assembly of claim 10, wherein the latching element is configured to pierce the partition material.

12. The support pole assembly of claim 11, wherein the partition material comprises a curtain.

13. The support pole assembly of claim 1, further comprising a flange configured for connection to the at least one support pole section.

14. The support pole assembly of claim 13, further comprising at least one rib supporting the flange.

15. The head attachment of claim 14, wherein the rib has a bowed curvature imparting a variable thickness along an axial length thereof.

16. A support pole assembly for erecting a temporary wall with a curtain on a job site, the assembly comprising: at least one support pole section having a threaded member; a head attachment configured to engage the threaded member, the head attachment defining a recess; and a retainer element hingedly attached to the head surface proximate the recess, the retainer element movable upwardly and outwardly away from the recess to an open position for draping the curtain over a portion of the head attachment and a closed position capturing a portion of the curtain in the recess, wherein the retainer element is recessed from the upper side when in the closed position has been added.

17. The support pole assembly of claim 16, wherein the head attachment defines an upper side for engagement with the curtain, and wherein the retainer element is substantially parallel with the upper side when in the closed position.

18. The support pole assembly of claim 16, further comprising a latching element.

19. The support pole assembly of claim 16 wherein the threaded member comprises one of a threaded stud and an adaptor configured for coupling with a threaded stud.

20. The support pole assembly of claim 16, wherein the head assembly further comprises a flange configured to engage the threaded member.

21. The support pole assembly of claim 20, further comprising at least one rib supporting the flange.

22. The head attachment of claim 21, wherein the rib has a bowed curvature imparting a variable thickness along an axial length thereof.

23. The head attachment of claim 16, further comprising a gasket extending on an upper surface of the head attachment.

24. The head attachment of claim 23, wherein the gasket is U-shaped.

25. A support pole assembly for erecting a temporary partition on a job site with at least one support pole section, said assembly comprising a pole having a support pole section and a head attachment mountable to said support pole section; said head attachment comprising a body and a retainer element hingedly attached to a body, said body is releasably connected to said pole support section, said retainer element having an upper and lower surface; said body having an upper surface, a lower surface opposing the upper surface, and a recess portion recessed from said upper surface, said recessed portion having an upper surface and is spaced from said upper surface and said lower surface, said recessed portion configured to receive a portion of said retainer element when said retainer is in said closed position; said retainer element having an upper side and a lower side opposing said upper side, said upper side of said retainer element is generally parallel with said upper surface of the body when said retainer element is in said closed position, said retainer element being movable upwardly and outwardly away from said upper surface of said recessed portion to an open position for draping a flexible partition material over a portion of said body and a closed position capturing the partition material between said lower side of said retainer element and said upper surface of said recessed portion of said body.

26. A support pole assembly for erecting a temporary partition on a job site with at least one support pole section, said assembly comprising a pole having a support pole section and a head attachment mountable to said support pole section; said head attachment comprising a body and a retainer element hingedly attached to a body, said retainer element being movable upwardly and outwardly away from a first portion of said body to an open position for draping a flexible partition material over a second portion of the body and a closed position capturing the partition material between said retainer element and said first portion of said body; said body having a generally planar upper surface and a lower surface opposing the upper surface; said retainer element having an upper side and a lower side opposing said upper side, said upper side of said retainer element is generally parallel with said upper surface of the body when said retainer element is in said closed position, said upper side of said retainer element is recessed from said upper surface of said body when in said closed position.

27. A support pole assembly for erecting a temporary partition on a job site with at least one support pole section, said assembly comprising a pole having a support pole section and a head attachment mountable to said support pole section; said head attachment comprising a body and a retainer element hingedly attached to a body, said retainer element being movable upwardly and outwardly away from a first portion of said body to an open position for draping a flexible partition material over a second portion of the body and a closed position capturing the partition material between said retainer element and said first portion of said body; said body having a generally planar upper surface and a lower surface opposing the upper surface; said retainer element having an upper side and a lower side opposing said upper side, said upper side of said retainer element is generally parallel with said upper surface of the body when said retainer element is in said closed position, said upper surface of said body defines a rim extending around said retainer element, said rim is U-shaped.

28. The support pole assembly as defined in claim 27, wherein said head attachment includes at least one recessed surface extending adjacent to said rim.

29. The support pole assembly as defined in claim 27, wherein said head attachment includes a gasket that is applied to said rim.

30. The support pole assembly as defined in claim 27, wherein said head attachment includes a latching element, said body includes a front side and a rear side opposing said front side, said front side including a slot, and a distal end of said latching element being received in said slot when said latching element is closed.

31. The support pole assembly as defined in claim 25, wherein said pole section includes a stud and an adaptor releasably connected to said stud; said body of said retaining element including an attachment flange on a lower side of said body, said attachment flange configured to be releasably connected to said adaptor so that said body is releasably connected to said pole support section.

32. The support pole assembly as defined in claim 25, wherein said upper side of said retainer element is generally parallel and lies in a similar plane with said upper surface of the body when said retainer element is in said closed position.

33. The support pole assembly as defined in claim 31, wherein said upper side of said retainer element is generally parallel and lies in a similar plane with said upper surface of the body when said retainer element is in said closed position.

34. The support pole assembly as defined in claim 25, wherein said upper side of said retainer element includes a moveable latch that is moveable between a locked and unlocked position, a front end of said moveable latch moveable into a slot in said body when said retainer element is in said closed position and said moveable latch is in said locked position, said moveable latch inhibiting said retainer element to move to said open position when said front end of said moveable latch is positioned in said slot in said body.

35. The support pole assembly as defined in claim 33, wherein said upper side of said retainer element includes a moveable latch that is moveable between a locked and unlocked position, a front end of said moveable latch moveable into a slot in said body when said retainer element is in said closed position and said moveable latch is in said locked position, said moveable latch inhibiting said retainer element to move to said open position when said front end of said moveable latch is positioned in said slot in said body.

36. The support pole assembly as defined in claim 34, wherein said front end of said moveable latch includes a pointed portion configured to penetrate the flexible partition material that is between said lower side of said retainer element and said upper surface of said recessed portion of said body when said retainer element is in said closed position and said moveable latch is in said locked position.

37. The support pole assembly as defined in claim 35, wherein said front end of said moveable latch includes a pointed portion configured to penetrate the flexible partition material that is between said lower side of said retainer element and said upper surface of said recessed portion of said body when said retainer element is in said closed position and said moveable latch is in said locked position.

38. The support pole assembly as defined in claim 25, wherein said body includes an opening that is positioned underneath said lower side of said retainer element when said retainer element in said closed position, said opening allowing access to said lower side of said retainer element when said retainer element in said closed position.

39. The support pole assembly as defined in claim 27, wherein said body includes an opening that is positioned underneath said lower side of said retainer element when said retainer element in said closed position, said opening allowing access to said lower side of said retainer element when said retainer element in said closed position.

* * * * *